US005520387A

United States Patent [19]

Snow

[11] Patent Number: 5,520,387

[45] Date of Patent: May 28, 1996

[54] TOY BOMB AND GAME

[76] Inventor: A. Ray Snow, 11810 Hidden Valley Rd., Sandy, Utah 84092

[21] Appl. No.: 309,964

[22] Filed: Sep. 20, 1994

[51] Int. Cl.[6] ..... A63F 9/08

[52] U.S. Cl. ..... 273/156; 273/153 R; 273/237

[58] Field of Search ..... 273/156, 237, 273/153 S, 153 R, 248, 440, 445, 446; 434/11; 446/473, 485, 177; 102/70.2

[56] References Cited

U.S. PATENT DOCUMENTS

| | | | |
|---|---|---|---|
| D. 245,276 | 8/1977 | Jenkins . | |
| D. 245,277 | 8/1977 | Jenkins . | |
| 3,737,168 | 6/1973 | Driskill | 273/156 |
| 4,103,890 | 8/1978 | Treasarden | 273/156 |
| 4,320,901 | 3/1982 | Morrison et al. | 273/153 R |

*Primary Examiner*—Vincent Millin
*Assistant Examiner*—Charles W. Anderson
*Attorney, Agent, or Firm*—Mallinckrodt & Mallinckrodt

[57] ABSTRACT

A toy bomb device includes a disarming apparatus installed in a simulated bomb device body. The bomb device is armed to start a timer which times a preset time period in which a player has to properly operate the disarming apparatus to disarm the bomb device before the bomb detonates at the end of the time period. The disarming apparatus may take the form of a spring biased member having a pin extending therefrom that must be seated on a holding land to disarm the bomb. The bomb may be included as part of a board game where disarming the bomb is required at various stages during the game.

16 Claims, 7 Drawing Sheets

TOY BOMB AND GAME

BACKGROUND OF THE INVENTION

1. Field

The invention is in the field of toys in the nature of a device requiring an activity to be performed within a set time period and games played with such toys.

2. State of the Art

There are several games currently available that include a timing device and the basis of the game is that a player performs a certain task within the time allotted. For example, a game called Perfection manufactured by Lakeside Games of Minneapolis, Minn. includes a toy device as shown in U.S. Pat. No. Des. 245,277 which has a tray with a plurality of openings to accommodate playing pieces of various geometric shape. The tray is spring-loaded and the device includes a timer. The timer is the tray moved to a cocked position, and a start button depressed to start timing. When all geometric-shaped playing pieces are placed into their proper receiving openings, a player may press the stop button to stop the timer. If the timer runs out before the stop button is pressed, the cocked spring-loaded tray is released to pop up in the device and disperse the pieces that have been placed in the receiving openings of the tray.

In a game called Guesstures manufactured by Milton Bradley Company, Springfield, Mass. the game includes a timing device into which a series of four cards are placed. The device is set and, upon start of a round of the game, the device is activated. Upon activation a timer operates to drop the four cards, at preset times one after the other, into the device. The cards each have a word thereon that a team member has to act out so that other team members guess the word and upon a correct guess, the card can be retrieved from the device if it has not yet fallen into the device. These games require some action to be successfully completed within the time allowed by the timer, but the timer devices employed in such games merely act as timing devices and do not require a skillful manipulation of the device itself to stop the timer within the timed period.

SUMMARY OF THE INVENTION

According to the invention, a toy, which may be incorporated as a part of a game, simulates a bomb that has been set to detonate within a preset time after arming of the bomb. The player has to disarm the bomb by skillful manipulation thereof prior to its detonation.

The bomb device includes a body, preferably of bomb or other dramatic configuration, with a disarming means mounted therein. Means is provided for arming the bomb to begin timing the period in which a player has to operate the disarming means to disarm the bomb prior to its detonation at the end of the timed period. If the time period expires without the bomb being successfully disarmed or if the player slips during operation of the disarming means, a simulated detonation of the bomb is indicated. If the disarming means is properly operated by a player within the time allowed, simulated detonation of the device is prevented. The simulated detonation of the device is indicated preferably audibly by an explosion sound emanating from the device, but could be indicated visually as by a flash of light, by a light going on, by a combination of light and sound, or by other indicating means, such as mechanical means. It is preferred to provide other indications during the time period for disarming the bomb, preferably audibly, such as by a sound, for example a chirping sound, when the device is first armed, and a ticking sound during the time period of the bomb when the player is attempting to disarm it. The ticking sound may speed up toward the end of the period and a whistle sound may be provided for one to three seconds immediately prior to detonation. A difficulty switch may be provided to change the time period allowed for disarming the bomb between a relatively long period (easy), a relatively short period (difficult), and an intermediate period.

In a preferred form of the invention, the disarming means includes a manipulation means having a rest position, a manipulation position, and a disarmed position. The manipulation means is biased toward its rest position, but means are provided for holding the manipulation means in its disarmed position against the bias of the bias means. Proper manipulation of the manipulation means is required so that the manipulation means interacts with the holding means to hold the manipulation means in disarmed position. The manipulation means may include a first movable member movable between a rest position and a displaced position. This may be a tubular member mounted for limited longitudinal and unrestricted rotational movement in a bore located in the bomb device body. The tubular member is biased, such as by a spring, to the limit of longitudinal movement in the bore in one direction which constitutes the rest position. A second movable member is mounted on the first movable member and movable with respect to the first movable member between a rest position and a displaced position. The second movable member may be a rod member extending through the tubular member and mounted for limited longitudinal movement through the tubular member. The rod member is biased in the same direction as the bias of the tubular member, such as by a spring, to the limit of longitudinal movement which constitutes the rest position. Therefore, in rest position, the tubular member extends from its mounting bore in one direction and the rod member extends from the tubular member in the same direction. In rest position of the manipulation means, both the tubular member and the rod member are in rest positions.

A manipulation knob is mounted on the rod member at the end opposite the direction of bias where it extends from the tubular member. A user grasps the manipulation knob to move the manipulation means from rest to manipulation position. In such movement, the rod member is moved against its bias in the tubular member to its displaced position and the tubular member is then moved against its bias to its displaced position. In the manipulation position of the manipulation means, both the tubular member and the rod member are in displaced positions. The tubular member and rod member rotate together and may be rotated in manipulation position. A pin extends outwardly from the tubular member and in manipulation position is above a plurality of tabs with lands thereon which surround the tubular member. The pin and tabs with lands thereon form a means for holding the manipulation means in disarmed position. The tubular member and rod member are rotated to attempt to position the pin above a land and then to lower the pin onto the land so that it will remain there as the knob is released. If the pin is successfully located on a land, it will hold the tubular member in displaced position against the bias of its associated spring while the rod member returns under the bias of its associated spring to its rest position. This condition where the tubular member is in displaced position and the rod member is in rest position constitutes the disarmed position of the manipulation means. In disarmed position, the end of the rod member toward the bias direction is in an intermediate position between its position when the manipulation means is in rest position and when the manipulation means is in its manipulation position.

Sensors are provided to sense when the manipulation means moves from rest or disarmed position to manipulation position, this arms the bomb device and starts timing, and when the manipulation means either returns to rest position during the time period (the player has slipped during disarming so the bomb detonates) or is held in disarmed position so the bomb is successfully disarmed and detonation is prevented. If the disarmed position is not sensed by the end of the time period, detonation occurs.

The bomb may be used alone as a toy, or as a game where two or more players challenge one another to disarm the bomb. It may also be part of a board game wherein players moving along a travel route on the board have to disarm the bomb at various locations in order to avoid consequences of detonation of the bomb. Winners may be determined by the first person to reach a predetermined goal and then successfully disarm the bomb.

THE DRAWINGS

The best mode presently contemplated for carrying out the invention is illustrated in the accompanying drawings, in which:

FIG. 1 is a perspective view of a toy bomb device of the invention;

FIG. 2, a vertical section of the toy bomb device of FIG. 1;

FIG. 3, a fragmentary perspective view of the toy bomb device of FIG. 1, with nose portion and top ring removed, and with a portion of the body cut away to show internal parts, such parts being shown in rest position;

FIG. 4, a fragmentary perspective view similar to FIG. 3, but showing some internal parts in a different position;

FIG. 5, a fragmentary perspective view similar to FIG. 3, but showing some internal parts in a different position;

FIG. 6, a fragmentary perspective view similar to FIG. 3, but showing some internal parts in a different position;

FIG. 7, a fragmentary perspective view similar to FIG. 3, but showing some internal parts in a different position;

FIG. 8, a fragmentary perspective view similar to FIG. 3, but showing some internal parts in a different position;

FIG. 9, a fragmentary perspective view of the toy bomb device of FIG. 1, with nose portion removed and with a portion of the body cut away to show internal parts in rest position;

FIG. 10, a top view of the device of FIG. 9;

FIG. 11, an unrolled view of the inside surface of the set ring;

FIG. 12, a fragmentary vertical section taken on the line 12—12 of FIG. 10;

FIG. 13, a circuit diagram of circuitry usable with the invention; and

FIG. 14, a representation of a game board useable with the device of the invention.

DETAILED DESCRIPTION OF THE ILLUSTRATED EMBODIMENT

Figure 1:
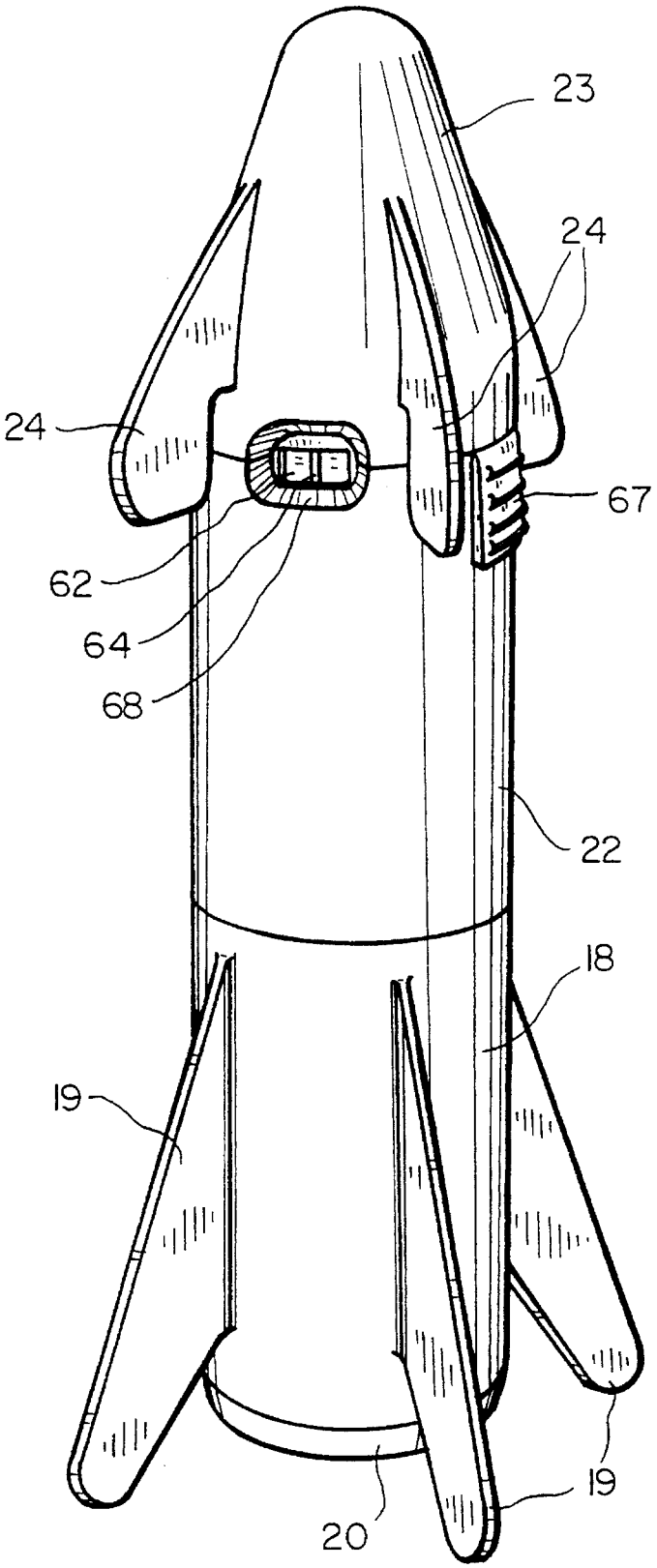
Figure 2:
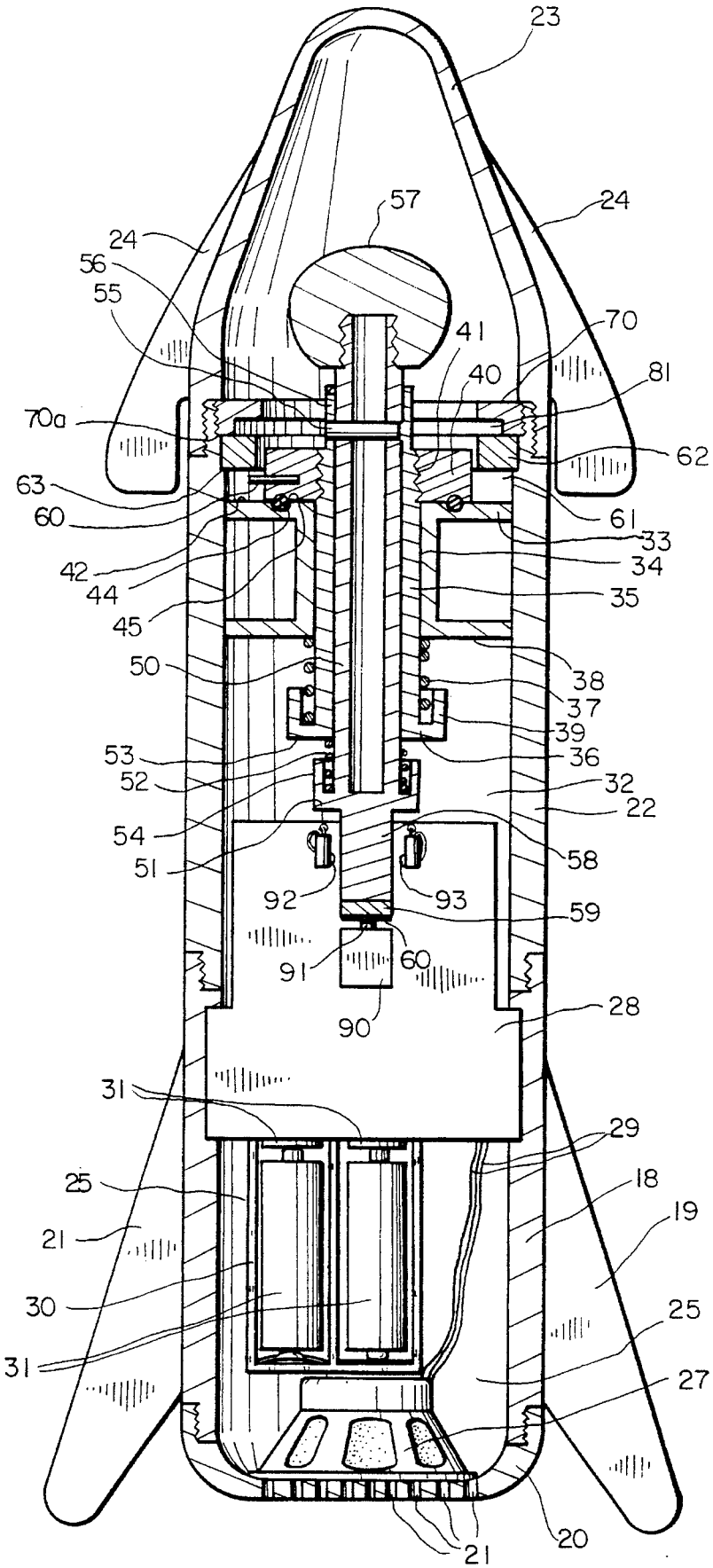

A toy bomb device of the invention, which could take many shapes, preferably takes a dramatic bomb-like shape including a lower body 18, FIG. 1, with tail fins 19 extending therefrom, a bottom 20 screwed onto the lower end of lower body 18, a central body 22 screwed onto the upper end of lower body 18, and an upper nose cone 23 screwed onto the upper end of central body 22 with nose fins 24 extending therefrom. The bomb is hollow to house the operating parts thereof within the body pieces. Thus, as shown in FIG. 2, lower body 18 includes an inner hollow area 25 in the bottom of which, on bottom 20, is mounted a speaker 27 and in the upper portion of which is mounted a printed circuit board 28 on which is mounted the electronic circuitry for the device. The printed circuit board is shown only schematically to indicate its mounting and the individual circuit components and their layout are not shown on the printed circuit board, except where such circuit components physically interact with other device components. The circuitry is shown in circuit diagram form in FIG. 13, and such circuitry could be laid out on the circuit board in a number of different ways obvious to those skilled in the art. Wires 29 extend from the circuitry on the printed circuit board 28 to speaker 27 and holes 21 through bottom 20 allow sound from the speaker to pass therethrough. A battery holder 30 with four batteries 31 removably held therein is also positioned in space 25. The upper end of printed circuit board 28 extends from space 25 in lower body 18 into space 32 in cylindrical central body 22.

A spring-loaded operating mechanism is mounted in space 32 inside central body 22 by collar 33 secured, such as by gluing, to central body 22. Collar 33 has a central opening or bore 34 therethrough which slidably and rotatably receives tubular member 35 therein. Tubular member 35 has a lower end shoulder 36 extending therefrom larger than opening 34 to abut and hold the end of a coil spring 37 which surrounds the lower end of tubular member 35. The other end of spring 37 abuts the bottom of the lower surface 38 of collar 33. An annular wall 39 may be provided to surround the lower end of spring 37 and to abut the collar lower surface 38 and form a stop when tubular member 35 is pulled upwardly against the bias of spring 37. A shoulder ring 40 is screwed onto an upper intermediate threaded portion 41 of tubular member 35 which abuts the upper surface 42 of collar 33 to prevent tubular member 35 from passing through central bore 34 of collar 33 under bias of spring 37, or merely under the influence of gravity when in position as shown in FIG. 2. As indicated, spring 37 biases shoulder piece 40 toward the upper surface 42 of collar 33. Preferably an O-ring 44 or other resilient gasket is provided in a receiving groove 45 in upper surface 42 to cushion shoulder piece 40 as it is urged toward surface 42 by spring 37, and preferably to hold it slightly away from surface 42.

A rod member 50 extends slidably centrally through tubular member 35 and has a lower intermediate shoulder 51 extending therefrom to abut an end of coil spring 52, whose upper end abuts the lower surface 53 of shoulder 36. Spring 52 urges rod member 50 downwardly with respect to tubular member 35. Annular wall 54 holds spring 52 and provides a stop for inner tubular member 50 when moved against the bias of spring 52 with respect to tubular member 35.

Figure 9:
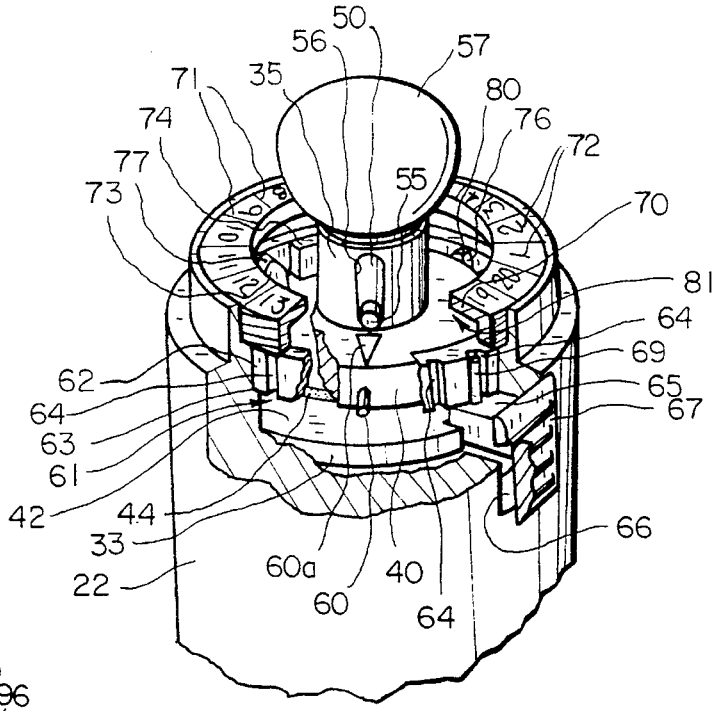

Rod member 50 is held within tubular member 35 against the bias of spring 52 by pin 55 secured in the upper portion of rod member 50 with an end thereof extend into slot 56 in the upper end portion of tubular member 35. Pin 55 abuts the lower end of slot 56 as shown in FIGS. 2 and 9 to prevent further downward movement of rod member 50 with respect to tubular member 35. Pin 55 in slot 56 also prevents relative rotation between rod member 50 and tubular member 35. The top end of rod member 50 is threaded to receive a knob 57 screwed thereonto, and the lower end portion 58 of rod member 50 has a cushioning material 59, such as a sponge or foam material, secured thereto with a more rigid lower surface 60 on the sponge material.

Figure 5:
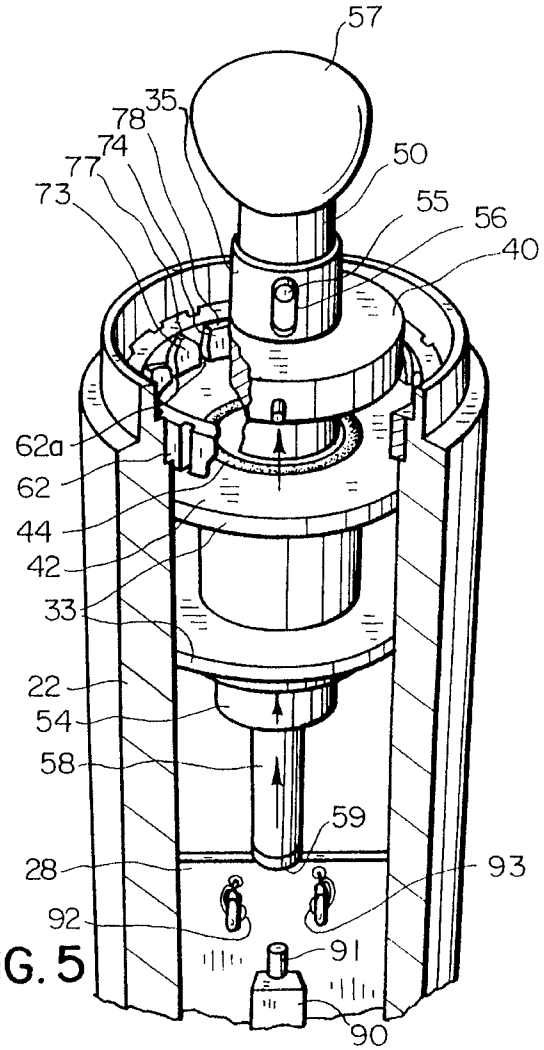
Figure 4:
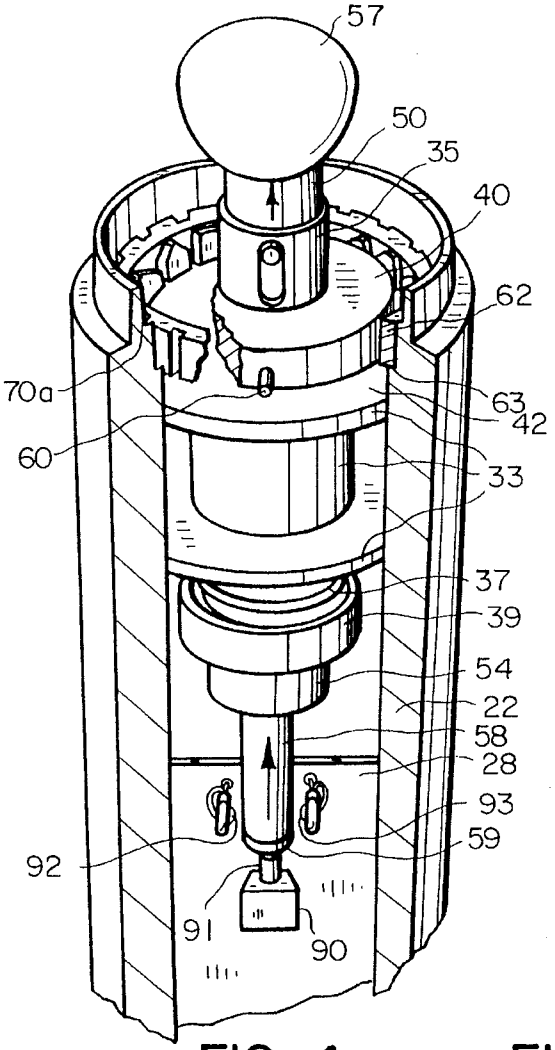
Figure 3:
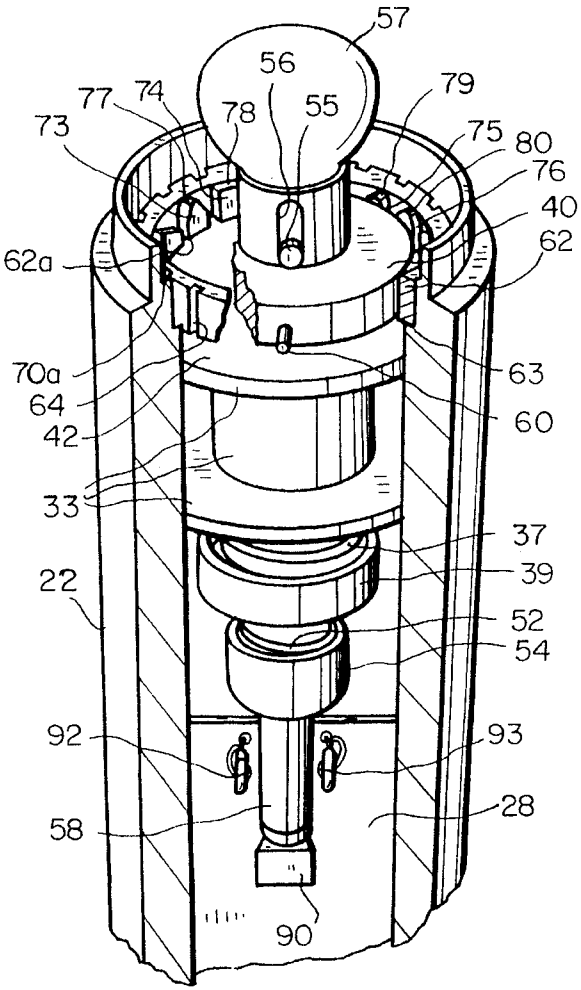
Figure 6:
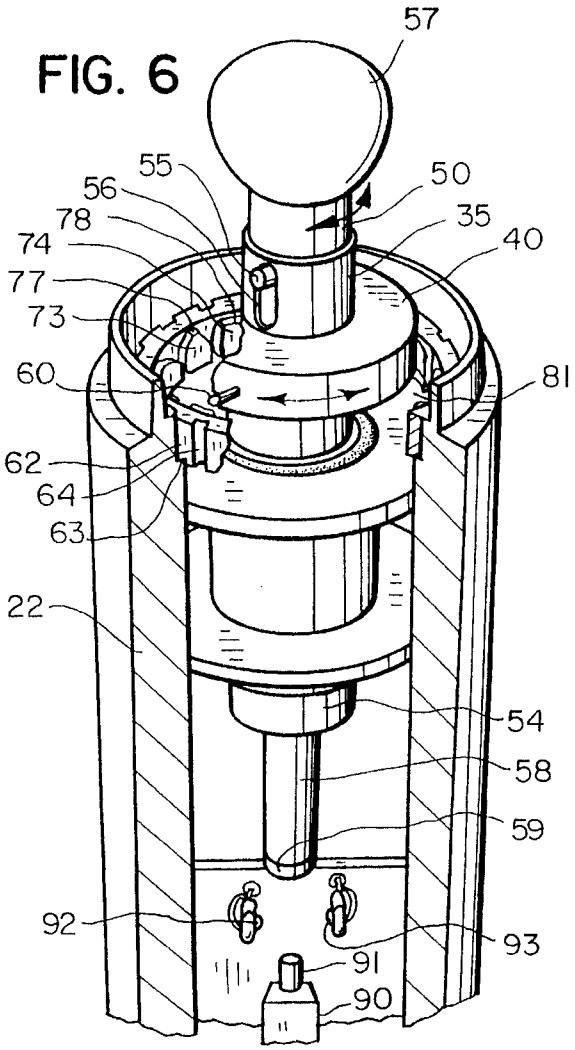

Spring 52 has a lesser compressive force than does spring 37 so that as knob 57 is pulled upwardly from its rest position shown in FIGS. 2 and 3, spring 52 will compress first so that rod member 50 moves upwardly with respect to tubular member 35 until the top of annular wall or stop 54 abuts the bottom of shoulder 53 of tubular member 35. This position is shown in FIG. 4. Further upward movement of knob 57 compresses spring 37 until annular wall or stop 39 abuts bottom surface 38 of collar 33. This position is shown in FIGS. 5 and 6.

Figure 12:
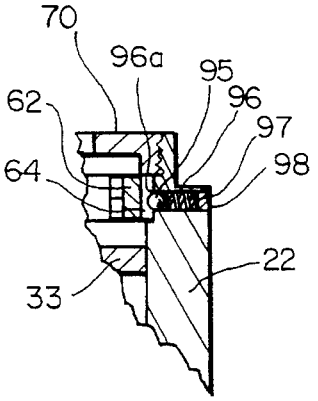
Figure 10:
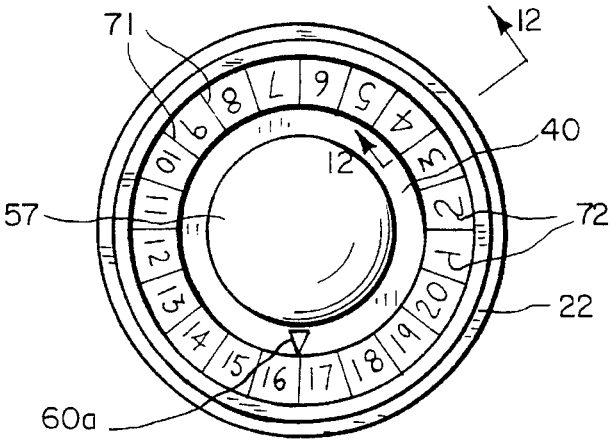

A pin 60 extends outwardly from shoulder ring 40 and when in rest position as shown in FIGS. 2, 3, and 9, extends into outwardly adjacent annular space 61. In this condition, knob 57, rod member 50, and tubular member 35 are free to rotate within bore 34. Rod member 50 and tubular member 35 rotate together because of the action of pin 55 in slot 56. A set ring 62 fits into the upper end of central body 22 against shoulder 63. Set ring 62 is freely rotatable in body 22 with vertical lock slots 64, FIGS. 1, 3, and 9, spaced evenly about the outer circumference. A locking slide 65, FIG. 9, extends through a slot 66 in central body 22 and has a thumb surface 67 by which a user can slide slide 65 up and down in slot 66. With slide 65 in its down position, set ring 62 can be rotated in body 22 and for this purpose, an opening 68, FIG. 1, is provided in bomb central body 22 to expose the outside edge of set ring 62 for movement by a user. The inner end of slide 65 has a locking pin 69, FIG. 9, extending upwardly therefrom. When slide 65 is in its down position, pin 69 is below ring 62. When slid upwardly, pin 69 moves into one of the locking slots 64 to lock set ring 62 in position and prevent it from rotating. A spring loaded ball 95, FIG. 12, is positioned in a hole 96 in wall 22, with spring 97 biasing the ball against a smaller inner opening **96*a* of hole 96 so that a portion thereof extends through hole 96*a* against the outer periphery of set ring 62. A plug 98 holds spring 97 in position. Ball 95 snaps into slots 64 as set ring 62 rotates to position a slot 64 over pin 69 so the ring can be easily locked in place. A top ring 70, FIGS. 2, 9, and 10, is screwed into the top of central body 22 against shoulder 70*a*. Top ring 70 is divided into a plurality of equal sectors by gradations 71 and the sectors between the gradations are numbered, preferably consecutively as shown by the numbers 1 and 2 indicated by reference number 72. For example, top ring 70** may be divided into twenty sectors numbered from one to twenty. Labels other than numbers, such as letters, could be used to differentiate the sectors.

Figure 8:
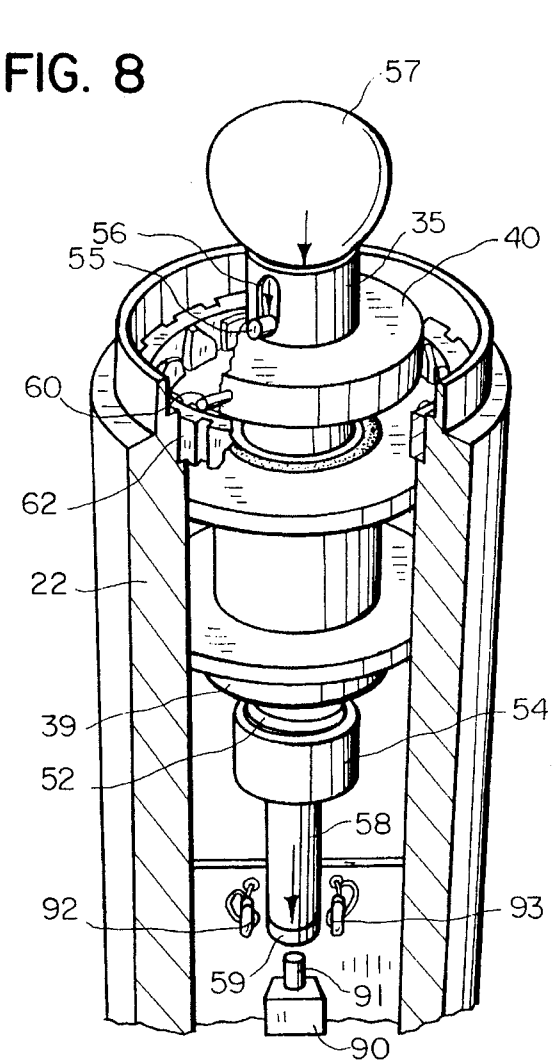
Figure 11:
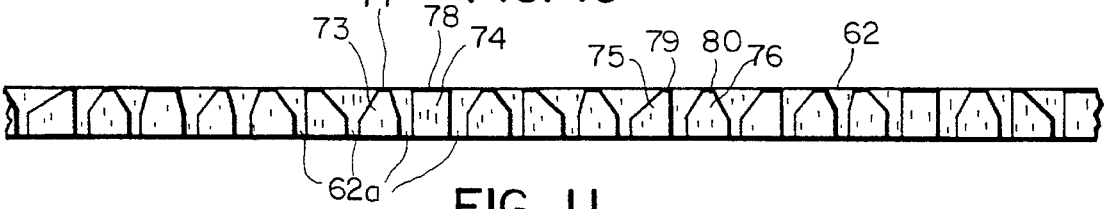

Extending inwardly from set ring 62 are a plurality of inward extensions or tabs, such as extensions 73–76, FIGS. 3 and 9 and with set ring 62 shown rolled out on a flat surface in FIG. 11, each with a flat land 77–80, respectively, on the top thereof. The number of inward extensions will be equal to the number of numbered sectors on the top ring 70. Thus, with twenty numbered sectors on top ring 70, twenty separate inward extensions would be provided on set ring 62 as shown in FIG. 11. With set ring locked in position under top ring 70 by locking pin 69 on slide 65, a tab or inward extension with land thereon is positioned substantially below each labeled sector of top ring 70. Pin 60 extending from shoulder ring 40 can pass between respective inward extensions as at **62*a* as knob 57 is pulled upwardly as shown in FIGS. 4 and 5, and when in upward position as shown in FIG. 5 is free to rotate above the inward extensions in annular space 81 between the respective inward extensions and the bottom of top ring 70, as shown in FIGS. 2 and 6. For each of the inward extensions, the pin 60 can be placed on the extension's land and such land will hold the pin, and thereby hold the tubular member 35, in a raised position against the bias of spring 37, while allowing rod member 50 to move downwardly under the bias of spring 52 to the position as shown in FIG. 8. Each of the lands is of different size and positioned on the inward extension differently so as to provide a range of difficulties in placing the pin on the land. For example, land 78 on inward extension 74 extends the entire width of extension 74. It is relatively easy to place pin 60 on land 78 so that it will remain there and hold tubular member 35 in a raised condition against the bias of spring 37 when knob 57 is released. Land 79 on extension 75 is smaller than land 78, so it is more difficult to position pin 60 thereon. Lands 77 and 80 are even smaller making it even more difficult to position pin 60 thereon. Further, lands 77 and 80 are positioned differently along the width of the respective extensions 73 and 76 and have differently sloped surfaces leading thereto to provide a different feel when a player tries to position pin 60 thereon. Top ring 70 covers set ring 62 and shoulder collar 40 fills in the central opening in top ring 70 when tubular member 35 is moved upwardly against the bias of spring 37 so that a user cannot see the respective lands and pin 60 during positioning of pin 60 on a land so the user has to position the pin on a land by feel. If the pin is not positioned correctly on the land, or is positioned on a sloped surface rather than directly on the land, when knob 57 is released, tubular member 35 will move downwardly under the bias of spring 37 while pin 60 slides downwardly along a sloped surface on an inward extension and between the inward extensions to the rest position shown in FIG. 3. An arrow 60*a*, FIGS. 9 and 10 on top of shoulder collar 40 points to the position of pin 60**.

Figure 7:
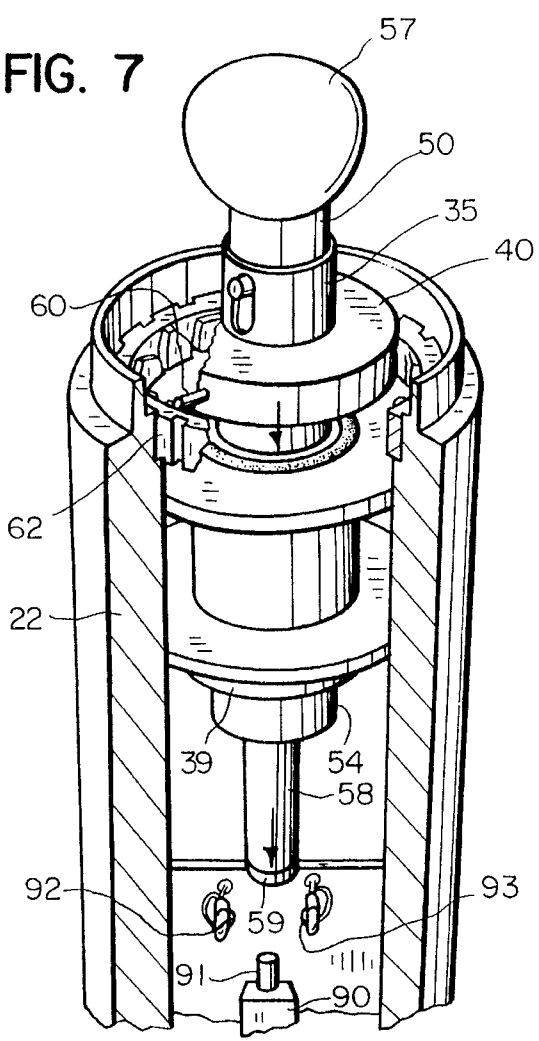

With the construction shown, the toy bomb device will start in rest position as shown in FIG. 3. The player will grasp knob 57 and pull it and rod member 50 upwardly as shown in FIG. 4 until stop 54 abuts shoulder 36. The player will continue pulling knob 57 upwardly as shown in FIG. 5 compressing spring 37 until stop 39 abuts lower surface 38 of collar 33. In this position, pin 60 has passed from annular area 61 below the set ring inward extensions, through a space **62*a* between the inward extensions, into the annular area 81 above set ring 62, and as shown in FIG. 6, pin 60 is free to rotate above the inward extensions. At this time the player has to successfully place or seat pin 60 on one of the lands on an inward extension. In some embodiments of a game played with the toy bomb, the player is assigned a designated disarming position to use in disarming the bomb. In the embodiment shown, this designated disarming position is a sector designated by top ring 70 and is indicated by a number among the numbers on top ring 70, such as a number between one and twenty for the top ring shown. The player then has to place pin 60 on the land under or associated with the assigned number. For this purpose, the player aligns arrow 60*a* with the appropriately numbered sector, and, keeping the arrow in the numbered sector, has to seat pin 60 on the land. Generally also, this has to be done within a preset time limit. If knob 57 is released and pin 60 is successfully located on a land as shown in FIG. 7, pin 60 stays on top of the land and rod member 50 moves downwardly while tubular member 35 remains in an up position (tubular member 35 will move down slightly as the pin 60 moves from its freely rotatable position above the various lands to a position resting on a land) as shown in FIG. 8. If pin 60 does not successfully rest on a land, it and tubular member 35 will also move downwardly to the rest position shown in FIG. 3**.

The rod member, outer tubular member, knob 57 and associated springs form a manipulation means for the bomb device. In moving from a rest position to a manipulation position where pin 60 is above set ring 62 so that it can be rotated or manipulated above the various lands, tubular member 35, which constitutes a first movable member and rod member 50, which constitutes a second movable member mounted on the first movable member for movement therewith, are both moved against respective bias means, springs 37 and 52, respectively, to displaced positions. During such movement, the lower end portion 58 of rod member 50 moves upwardly, first through tubular member 35 as tubular member 35 remains in place, as shown in FIG. 4, and then along with tubular member 35 as tubular member 35 moves upwardly, as shown in FIG. 5, to manipulation position shown in FIG. 6. If pin 60 is moved to successfully rest on a land to hold tubular member 35 in its up position against the bias of spring 37 when knob 57 is released, rod member 50 will move downwardly, as shown in FIG. 7, to an intermediate or disarmed position as shown in FIG. 8, which is between the rest position shown in FIGS. 2 and 3 and the manipulation position shown in FIG. 6. Pin 60 and the various lands form a means for holding the manipulation means in disarmed position.

In order to operate the bomb device, the bomb has to be armed at the start of a manipulation session and a simulated detonation has to be indicated if the bomb device is not disarmed during a preset time period after it has been armed. For this purpose, it is necessary to be able to sense when the manipulation means is in rest position, when it is moved from rest position to manipulation position, and when it is successfully placed in disarmed position. In the embodiment shown, the circuit board 28 is positioned with respect to the lower end portion 58 of rod member 50 so that push button switch 90 with switch actuator 91 are mounted thereon in a position wherein switch actuator 91 is depressed into switch 90 to thereby actuate switch 90 when the manipulation means is in rest position, here, when the lower end portion 58 of rod member 50 is in its fully downward or rest position as shown in FIGS. 2 and 3. Cushioning material 59 cushions operation of switch 90 while surface 60 makes sure that the switch is operated in the rest position. As lower end portion 58 moves upwardly when knob 57 is grasped by a user and pulled upwardly to move the manipulation means to manipulation position, it moves away from switch 90 allowing switch actuator 91 to move outwardly to a nonactuated switch position as shown in FIGS. 4–8. It should be noted that the actuated and nonactuated positions of the switch do not necessarily mean the closed and open conditions of the switch as contacts of the switch could be either closed or open in actuated and nonactuated position, but merely refers to the relative position of switch actuator 91 in respect to switch 90.

A sensor made up of a light source 92 and a light receiver 93 is positioned on circuit board 28, FIGS. 2–8, so that the lower end portion 58 of rod member 50 is positioned between source 92 and receiver 93 when in rest or in disarmed positions. Thus, as rod member 50 and tubular member 35 are moved from rest position through intermediate disarmed position into manipulation position as shown in FIGS. 3–5, lower end portion 58 moves upwardly and, in manipulation position, FIG. 6, is no longer between source 92 and receiver 93. When lower end 58 is between source 92 and receiver 93, it blocks transmission of light from source 92 to receiver 93. When lower end 58 is not between source 92 and receiver 93, light from source 92 falls onto receiver 93. Source 92 may be a light emitting diode or other light source while receiver 93 may be a phototransistor or photoresistor which acts as a switch or changes properties between a lit and unlit condition. In this way, receiver 93 acts as a sensor to determine when lower end portion 58 is in position between the source and receiver or is not in such position.

Switch 90 and source 92 and receiver 93 are incorporated into electronic circuitry that includes a timing means, such as an electronic timer, and indicator means, such as a speaker device, so that as the manipulation means is moved to manipulation position, causing lower end portion 58 to move from between source 92 and receiver 93, the bomb device becomes; armed and the timer begins its timing cycle. The arming of the device may be indicated by an audible signal such as a chirp, and the timing may be indicated by audible ticking. Such ticking may speed up as the end of the time period is approaching and a whistle may start and extend during the last two seconds or so of the time period. At the end of the time period, unless detonation has been prevented by disarming the bomb, an audible explosion sound may be produced.

As previously indicated, to disarm the bomb, it is necessary to seat pin 60 on a land so that knob 57 can be released to allow rod member 50 to move downwardly while tubular member 35 remains in upward position. In this disarmed position, FIG. 8, lower end portion 58 of rod member 50 extends between source 92 and receiver 93, but does not actuate switch 90. Thus, if after arming the bomb device by lower end portion 58 moving from switch 90 and from between source 92 and receiver 93, lower end portion 58 again moves between source 92 and receiver 93, without actuating switch 90, this signals that the bomb device has been disarmed and timing and ticking stop. If, however, after arming, end portion 58 does not come between source 92 and receiver 93 within the time period, the simulated detonation of the bomb takes place. In addition, if end portion 58 actuates switch 90, indicating that the player has slipped and done something wrong during disarming, detonation immediately takes place.

Figure 13:
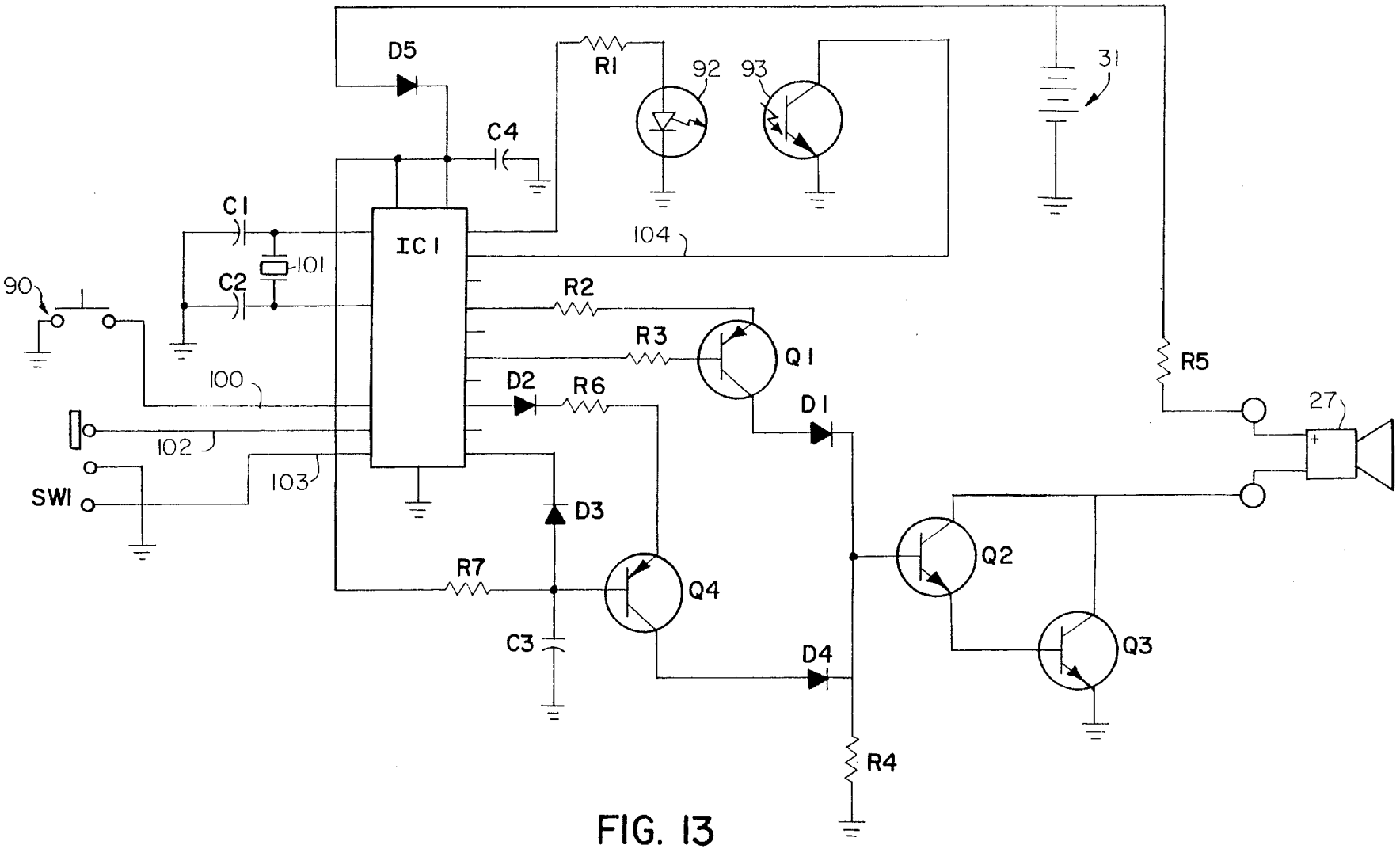

FIG. 13 shows circuitry suitable for use with the invention. The heart of the circuitry is a microcontroller IC1, such as a 16C71 cmos microcontroller. This microcontroller has the ability to shut itself off and sleep, without power consumption, until it is awakened by a logic change on line 100. This logic change is accomplished by switch 90 which is closed when the device is in rest position and open (the position shown) when the device is in other positions. When closed, switch 90 grounds line 100 to provide a logic "0" or a logic low. When opened, line 100 goes high to provide a logic "1" in logic high. When in sleep mode, opening switch 90 will activate IC1 and start the timer operation. This arms the bomb. Timing pulses are provided by crystal 101 with the ends of crystal 101 connected to IC1 and to ground through respective capacitors C1 and C2. The length of the period timed from arming to detonation is set by the inputs on lines 102 and 103. Switch SW1 can be moved to three positions. In the position shown, both inputs are logic highs, which sets the circuitry to a preset time period. Switch SW1 can be moved to ground line 102 which gives a low input on line 102 and high on 103 to set the circuitry to a second preset time period. Switch SW1 can be further moved to ground line 103, leaving line 102 high to set the circuitry to a third preset time period. The three preset time periods are provided to give a relatively long period, preferably about seventeen seconds between arming and detonation, to provide an easier setting, a relatively short period, preferably about seven seconds, to provide a difficult setting, and an intermediate period, preferably about twelve seconds. This time period determines how quickly the bomb must be disarmed. The light source 92 is an infrared light emitting diode which is powered through current limiting resistor R1 from IC1, and receiver 93 is a phototransistor which forms an open circuit and logic high on line 104 when the light from source 92 is blocked and forms a closed circuit to ground and logic low on line 104 when the light from source 92 falls onto it, thereby grounding line 104. When microcontroller IC1 is awake, the bomb may be armed and timing started, by either opening switch 90 or by causing phototransistor 93 to ground line 104. During the timing period, if phototransistor 93 is opened so that line 104 goes high, indicating the manipulation means is in blocking position between source 92 and phototransistor 93, and switch 90 is open, meaning that the manipulation means has not returned to rest position, timing of the period is stopped as the bomb has been successfully disarmed. The circuit formed by resistors R2, R3, and R4, transistors Q1, Q2, and Q3, and diode D1 form a driving circuit for speaker 27. Resistor R5 limits the current through the speaker. The circuitry formed by resistors R6 and R7, diodes D2, D3, and D4, transistor Q4, and capacitor C3 form a decay circuit controlled by microcontroller IC1 which sums with the drive circuit to create desired sound effects.

The circuitry is powered by batteries 31 with the positive battery terminals connected through diode D5 to the microcontroller IC1 and to the decay circuitry, with capacitor C4 acting as a filter. By use of the microcontroller indicated, which goes into a sleep mode after a period of inactivity, battery life is increased and a manual "on"-"off" switch is not required.

The microcontroller is programmed to start the timing period upon arming of the bomb. It causes a chirping or other sound to indicate arming of the bomb. The microprocessor then causes a ticking sound during the timing period with initially a slow tick of, for example, every second, speeding up during the last four seconds and with a whistle sound during the last two seconds. It then causes a bomb blast or explosion noise to indicate detonation.

After detonation or after disarming of the bomb, a soft tick continues about every eight seconds for about four minutes until the microcontroller and circuitry goes back to sleep if the bomb is not armed again during that period.

The toy bomb device of the invention may be used in a number of different ways. During use of the bomb device illustrated, the nose cone 23 is removed. Depending upon the shape and arrangement of the bomb device, removing the nose cone, or otherwise opening the body of the bomb device to gain access to the disarming means, may or may not be necessary. The bomb device can be used by one person who merely tries to disarm it within the time allowed. It can be used by two or more people who pass the bomb from one person to the other and call out a number as the bomb is passed so that the person trying to disarm the bomb must do so in connection with the designated number. Further, the bomb may be a piece for use in connection with a board game which also includes a playing board having at least one travel route, a multiface die with the number of faces equal to the number of sectors around top ring 70, a normal six face die, and preferably a set of clue cards, at least one set of draw cards, a set of cancel cards, a set of start cards, and a penalty card. In the embodiment of bomb device shown, the number of sectors on top ring 70 is twenty so the multiface die has twenty faces with numbers from one to twenty thereon.

Figure 14:
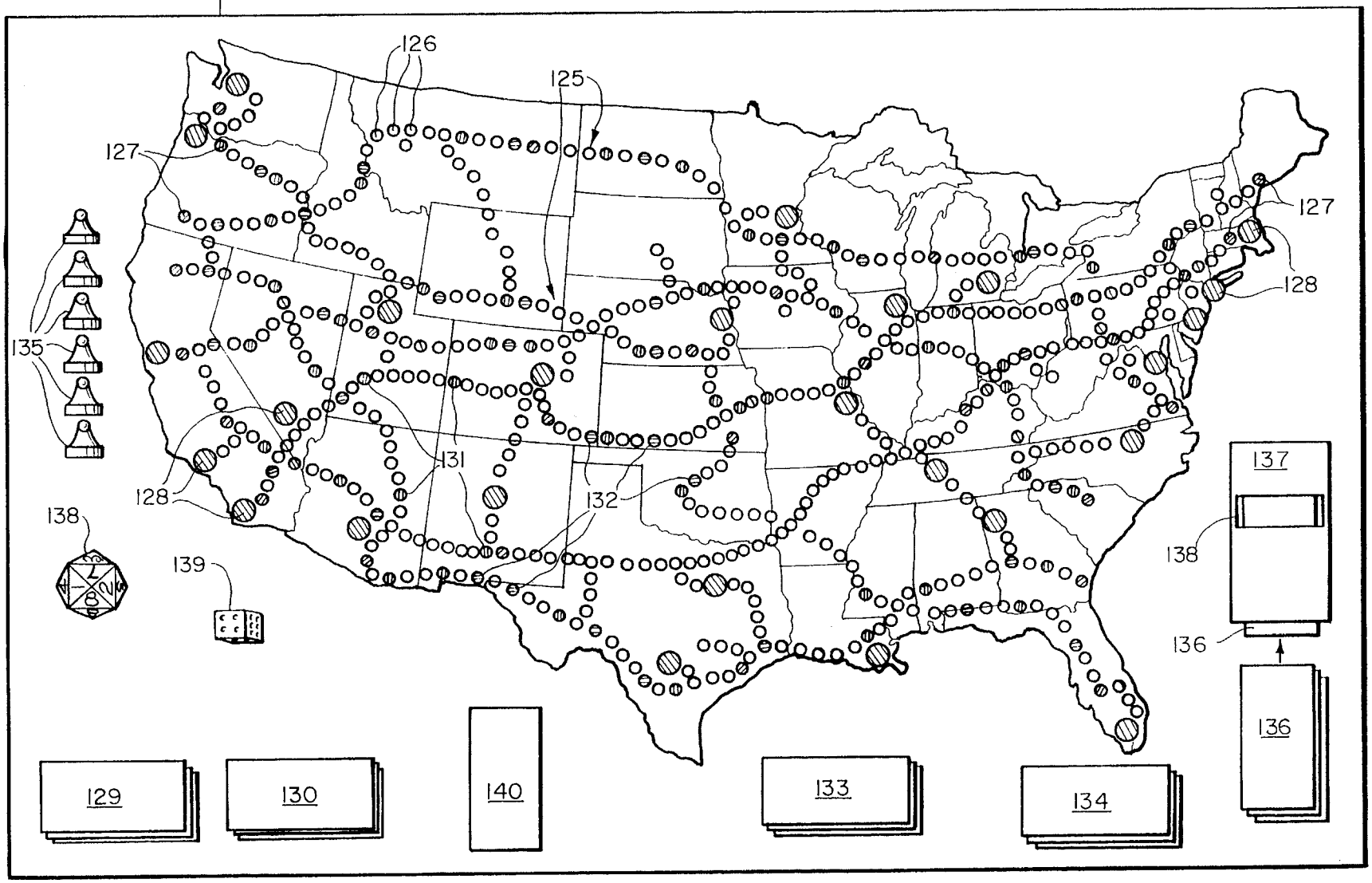

The board 124, as shown in FIG. 14, will generally have a representation of a geographic area, such as the United States, and, as shown, preferably has a number of travel paths 125, such as six, one for each player up to six players, extending across the United States and made up of a number of spaces shown as dots 126. Specially colored dots 127 at the beginning and end of each travel path and intermediate the travel paths indicate training centers, each route having an equal number of training centers such as four training centers. The training center dots are shown lined for the color brown. Larger dots 128 are shown around the board and lined for the color green and represent cities in which a bomb may be located for each game and to which city all players will be directed at the end of the game to disarm the bomb. These cities may be referred to as "Ground Zero" cities. Other dots may be colored along the route to indicate that a draw card should be taken. A deck of red draw cards 129 and a deck of blue draw cards 130 may be provided with red dots 131 and blue dots 132 scattered along each travel path. If a player lands on a red or a blue dot, the appropriately colored card is taken. Each draw card can have instructions thereon, one color, such as red cards 129 being bad cards and blue cards 130 being good cards. If desired, each player may be given one or more cancel cards 133 at the beginning of a game to use to cancel a draw card.

In one embodiment of the game, start cards 134 are provided with one card for each route, the card having the name of the starting training center and the other training centers along the way. Each player has a playing piece 135 of a different color and draws a start card 134 which tells the player where to start, which route to follow, and the training centers along the way. A travel route may start on the East Coast or the West Coast. Each player then places his or her playing piece 135 on the starting training center indicated by the start card. The start card can also indicate what type of training bomb—tear gas bomb, stink bomb, water bomb, etc.—has to be disarmed at each training center. The game also includes a deck of clue cards 136, one for each "Ground Zero" city on the game board with each card having two clues as to the card's city and then the name of the city spaced apart on the card. One card is drawn per game and the card is placed in a card holder 137 having an opening 138 therein through which a clue or the name of the city on a clue card will show depending upon the position of the card in the card holder.

Initially, and at each training center along the route, the player rolls both a twenty face die 138 and a six face die 139. The twenty face die tells the player which number on the bomb must be used for disarming. The normal six face die tells the player how many spaces to move if he or she successfully disarms the bomb. If the player does not successfully disarm the bomb, at the initial training center, the player must wait a turn without moving along the route and try again next turn. At intermediate and the last training center along the route, the penalty for not successfully disarming the bomb may depend upon the type of bomb involved. The start card 134 indicates the type of bomb, and a penalty card 140 may indicate the penalty of each type of bomb.

As the player moves along the route and lands on a red or blue colored dot that indicates a draw card, red card 129 or blue card 130 should be drawn. These cards give special instructions, such as to return to a previous training site for additional training, etc., which a player must follow, or use a cancel card to nullify the draw card.

When a player reaches his or her final training center at the end of his travel path and successfully disarms the final training bomb, he or she may secretly look at the first clue of the selected clue card 136 using holder 137 to hide the second clue and name of the city. The player may start moving toward that "Ground Zero" city the number of spaces shown on the normal six face die, if he or she knows the city or thinks he or she know it. On the next turn, the player may look at the second clue for the city, and on the turn thereafter, may look at the name of the city. All players head to the same final "Ground Zero" city and when reaching the city by exact count, must disarm the bomb a final time. The first player to successfully disarm the bomb at the "Ground Zero" city is the winner of the game.

In the board game, a variety of means, such as spinners or cards, could be used to indicate the number to use when disarming the bomb and the number of spaces to move. Further, variations of draw cards, clue cards, and start cards can be used, or various of those eliminated.

After playing with the bomb device a number of times, a player may learn the positioning of a land and how to place the pin on a land for a particular number. If such is the case, or at various times to prevent that from becoming the case, slide 66 is moved to down position, and set ring 62 is rotated to reposition the lands with respect to the sectors on top ring 70.

While the bomb device of the invention has been described as having a bomb shape, various shapes may be used and various arrangements of manipulation means to disarm the bomb may be used. Various sounds and sound combinations, or other indicators such as visual indicators in addition to sound or in place of sound may be used. Further, while various references to up, upwardly, above, down, downwardly, or below have been used, these have been used in connection with the orientation of the bomb device shown in the Figs. The manipulation means of the bomb device will work in various orientations and the bomb device and internal components could be arranged in various orientations.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A toy bomb device which can be armed and then which has to be disarmed within a preset time period before a simulated detonation, comprising:

a body;

manipulation means mounted in the body, said manipulation means having a rest position, a manipulation position, and a disarmed position, and including:

a first movable member movable between a rest position and a displaced position;

means biasing the first movable member to rest position;

a second movable member mounted on the first movable member for movement with the first movable member and movable with respect to the first movable member between a rest position and a displaced position; and means biasing the second movable member to rest position;

means for holding the manipulation means in disarmed position upon proper manipulation of the manipulation means in manipulation position;

timing means to set a predetermined allowable time period after arming of the device for manipulation of the manipulation means prior to simulated detonation of the device;

means for arming the device;

means for indicating simulated detonation of the device;

means for preventing simulated detonation of the device if the manipulation means is held in its disarmed position within the time period for manipulation;

wherein to move the manipulation means to manipulation position both the first and second movable members are moved to displaced positions; and wherein the means for holding the manipulation means in disarmed position holds one of the movable members in displaced position while the other movable member moves back to rest position.

2. A toy bomb device according to claim 1, wherein the movable member held in displaced position when the manipulation means is in disarmed position is the first movable member; wherein the means for holding the manipulation means in disarmed position includes a pin extending from the first movable member, and land means associated with the body to receive and hold the pin extending from the first movable member when the first movable member is properly manipulated to position the pin on the land means to thereby hold the first movable member in displaced position while the second movable member moves back to rest position.

3. A toy bomb device according to claim 2, wherein the land means includes a plurality of spaced lands on which the pin may be received, the lands of the plurality of lands being of different sizes whereby it is more difficult to position the pin on some lands than on other lands.

4. A toy bomb device according to claim 3, wherein the general location of each of the lands of the plurality of lands is separately indicated so a particular land on which the pin is to be positioned may be designated.

5. A toy bomb device according to claim 3, wherein the plurality of lands extend in a ring around the first movable member, wherein when the manipulation means is in manipulation position, the first movable member with pin extending therefrom may be rotated with respect to the land means, whereby the pin may be positioned on a selected land of the plurality of lands.

6. A toy bomb device according to claim 5, including a ring covering the lands and spaced therefrom to provide an annular space for movement of the pin with respect to the lands between the lands and the ring, said ring hiding the lands and pin from sight, gradation means oil the ring to divide the ring into a plurality of sectors, the plurality of sectors being equal to the plurality of lands and each sector indicating the approximate position of a land around the first movable member and each sector being labeled, and indicator means on the first movable member which can be directed to a labeled sector to designate a land on which the pin is to be positioned.

7. A toy bomb device according to claim 6, wherein the body includes a mounting bore;

wherein the first movable member is a tubular member which extends through the mounting bore and is rotatable therein, said tubular member being longitudinally movable in the mounting bore between a rest position and a displaced position; and wherein the second movable member is an inner rod member which extends through the tubular member and is mounted therein for longitudinal movement between a rest position and displaced position.

8. A toy bomb device according to claim 7, including a manipulation knob by which a player may grasp the maniuplation means to move it to manipulation position and rotate it when in manipulation position, said manipulation knob being secured to the end of the rod member opposite the direction of bias.

9. A toy bomb device according to claim 8, including a rest position sensor which senses when the manipulation means is in rest position, and a disarmed position sensor which senses when the manipulation means is in disarmed position, and wherein the timing means, means for arming the device, means for indicating simulated detonation of the device, and means for preventing simulated detonation of the device, include electronic circuitry interconnected with the rest position sensor and the disarmed position sensor and operable to arm the device by initiating operation of the timing means upon sensing movement of the manipulation means from rest position or from disarmed position, and simulating detonation of the bomb at the end of the time period unless the manipulation means is sensed as in disarmed position prior to the end of the time period.

10. A toy bomb device according to claim 9, wherein the electronic circuitry includes a programmed microcontroller.

11. A toy bomb device according to claim 6, including means for changing the position of the plurality of lands with respect to the labeled sectors.

12. A toy bomb device according to claim 1, including a rest position sensor which senses when the manipulation means is in rest position, and a disarmed position sensor which senses when the manipulation means is in disarmed position, and wherein the timing means, means for arming the device, means for indicating simulated detonation of the device, and means for preventing simulated detonation of the device, include electronic circuitry interconnected with the rest position sensor and the disarmed position sensor and operable to arm the device by initiating operation of the timing means upon sensing movement of the manipulation means from rest position or from disarmed position, and simulating detonation of the bomb at the end of the time period unless the manipulation means is sensed as in disarmed position prior to the end of the time period.

13. A toy bomb device according to claim 1, wherein the means for arming the bomb arms the bomb when the manipulation means moves to manipulation position.

14. A toy bomb device according to claim 1, wherein the means for indicating simulated detonation of the device indicates simulated detonation if the manipulation means moves back to its rest position during the period for manipulation.

15. A toy bomb device which can be armed and then which has to be disarmed within a preset time period before a simulated detonation, comprising:

a body;

manipulation means mounted in the body, said manipulation means having a rest position, a manipulation position, and a disarmed position;

means biasing the manipulation means to rest position;

means for holding the manipulation means in disarmed position upon proper manipulation of the manipulation means in manipulation position;

timing means to set a predetermined allowable time period after arming of the device for manipulation of the manipulation means prior to simulated detonation of the device;

means for arming the device;

means for indicating simulated detonation of the device;

means for preventing simulated detonation of the device if the manipulation means is held in its disarmed position within the time period for manipulation;

a rest position sensor which senses when the manipulation means is in rest position;

a disarmed position sensor which senses when the manipulation means is in disarmed position; and wherein the timing means, means for arming the device, means for indicating simulated detonation of the device, and means for preventing simulated detonation of the device, include electronic circuitry interconnected with the rest position sensor and the disarmed position sensor and operable to arm the device by initiating operation of the timing means upon sensing movement of the manipulation means from rest position or from disarmed position, and simulating detonation of the bomb at the end of the time period unless the manipulation means is sensed as in disarmed position prior to the end of the time period.

16. A toy bomb device which can be armed and then which has to be disarmed within a preset time period before a simulated detonation, comprising:

a body;

manipulation means mounted in the body, said manipulation means having a rest position, a manipulation position, and a disarmed position;

means biasing the manipulation means to rest position;

means for holding the manipulation means in disarmed position upon proper manipulation of the manipulation means in manipulation position;

timing means to set a predetermined allowable time period after arming of the device for manipulation of the manipulation means prior to simulated detonation of the device;

means for arming the device;

means for preventing simulated detonation of the device if the manipulation means is held in its disarmed position within the time period for manipulation; and means for indicating simulated detonation of the device if the device is not held in its disarmed position within the time period for manipulation or if the manipulation means moves back to its rest position during the period for manipulation.

* * * * *